US007371125B2

(12) United States Patent
McHugh et al.

(10) Patent No.: US 7,371,125 B2
(45) Date of Patent: May 13, 2008

(54) MINIATURE AUDIO JACK CONNECTOR

(75) Inventors: Robert G. McHugh, Golden, CO (US); Zhang-Lan Xue, Kunshan (CN); Hong-Qiang Han, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/492,143

(22) Filed: Jul. 24, 2006

(65) Prior Publication Data

US 2008/0032562 A1 Feb. 7, 2008

(51) Int. Cl.
*H01R 24/04* (2006.01)

(52) U.S. Cl. ..... 439/668; 439/188

(58) Field of Classification Search ..... 439/668, 439/188, 669, 944

See application file for complete search history.

(56) References Cited

U.S. PATENT DOCUMENTS 6,312,274 B1 * 11/2001 Lin ..... 439/188
6,319,030 B1 * 11/2001 Wu ..... 439/188
6,595,804 B2 * 7/2003 Nagata ..... 439/668
6,908,343 B1 * 6/2005 Hu ..... 439/668
7,238,059 B1 * 7/2007 Wu ..... 439/668

* cited by examiner

*Primary Examiner*—Michael C. Zarroli
(74) *Attorney, Agent, or Firm*—Wei Te Chung

(57) ABSTRACT

A miniature audio jack connector (100) for electrically connecting a mating plug (200) includes an arched insulative housing (1), a number of conductive contacts (2) retained in the housing (1) and a pair of switch contacts (3) containing a movable contact (31) and an immovable contact (32). The housing defines a top wall (13), a plug-insertion hole (16) and an opening (134) through the top wall. The movable contact defines an elastic arm (312) with an emboss (313) extending into the plug-insertion hole and a mating portion for connecting with the immovable contact. The arm (312) is movable within the opening (134), thereby minimizing the profile of the insulative housing (1).

17 Claims, 7 Drawing Sheets

MINIATURE AUDIO JACK CONNECTOR

BACKGROUND OF THE INVENTION

1. Field of the Invention

This invention generally relates to an electrical connector, and more particularly to a miniature audio jack connector with a low profile and having a switch function.

2. Description of the Prior Art

Nowadays, electrical devices are becoming smaller and smaller, thereby providing limited space for mounting connectors therein. U.S. Pat. No. 6,312,274 B1, discloses a conventional audio jack connector comprising an insulative housing, a plurality of contacts accommodated in the insulative housing and a rear cover for resisting the contacts. The insulative housing defines a plug-insertion hole extending therethrough and an opening in communication with the plug-insertion hole, wherein the opening is disposed within the housing. The contacts contain a pair of switch contacts including a movable contact and an immovable contact for mating with the movable contact. The movable contact defines a bending arm extending into the plug-insertion hole. When the mating plug is inserted in the plug-insertion hole, it abuts against the bending arm and the bending arm moves outwardly in the housing. The movable contact deviates from the immovable contact, thereby achieving switch purpose. However, with this arrangement, the insulative housing must provide a certain inside space for a movement of the bending arm.

Hence, it is desired to have a miniature audio jack with a pair of switch contacts but occupying a relatively small inside space of an insulative housing

BRIEF SUMMARY OF THE INVENTION

Accordingly, an object of the present invention is to provide a miniature audio jack connector with a pair of switch contacts and occupying a relatively small space.

In order to attain the objective above, an audio jack connector for electrically connecting a mating plug comprises an insulative housing, a plurality of conductive contacts retained in the housing, a pair of switch contacts containing a movable contact and an immovable contact for mating with the movable contact, a post and a rear cover. The housing defines a bottom wall, a pair of side surface respectively extending upward from the lateral sides of the bottom wall, an arched top wall and a plug-insertion hole extending within the insulative housing. The housing further contains a plurality of mounting holes for retaining the contacts therein. The mounting hole further contains an opening defining a retaining wall thereof. The conductive contacts comprise a first contact, a second contact and a third contact wherein each conductive contact defines an emboss extending into the plug-insertion hole and a solder portion extending beyond the insulative hosing. The movable contact defines an elastic arm with an emboss extending into the plug-insertion hole and a mating portion in the distal end of the arm. The immovable contact defines a contact portion abutting against the retaining wall for connecting/disconnecting the mating portion. The arm is moving in the opening formed by entity thickness of the top wall, thereby minimizing the profile of the housing.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 7:
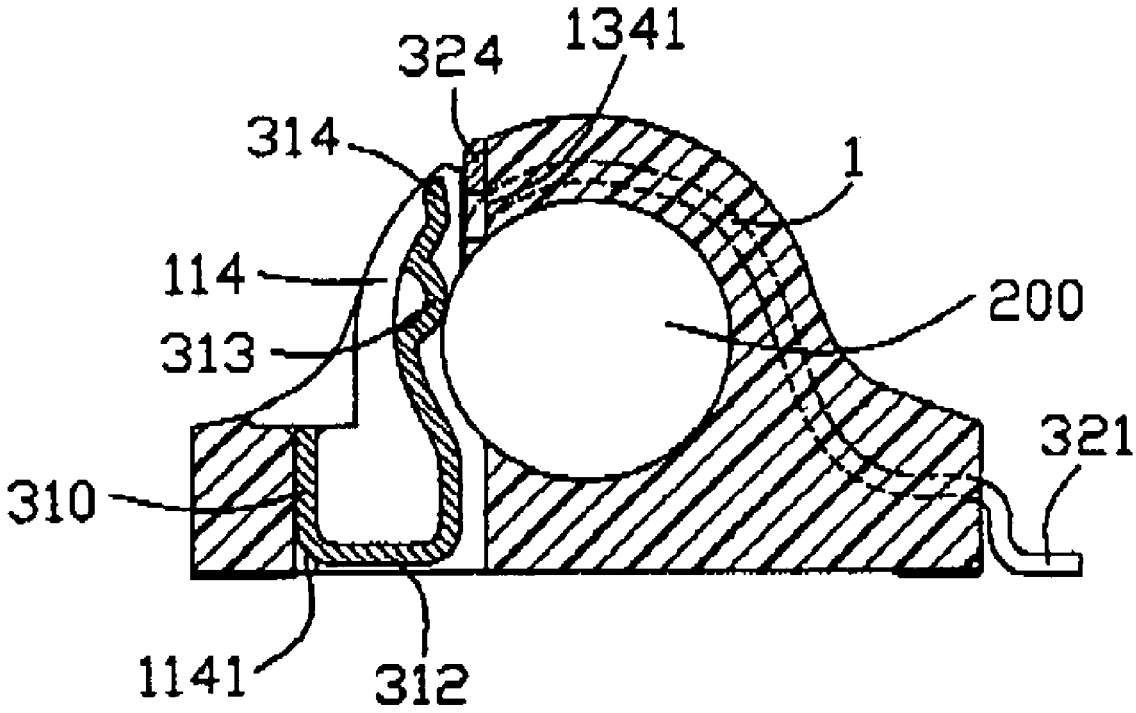
FIG. 7 is a view similar to FIG. 6 while the mating plug is inserted therein.

Refer to the drawings and in particular to FIGS. 1-4, a miniature audio jack connector 100 in accordance with the present invention for electrically connecting a mating plug 200 (shown in FIG. 7) comprises an arched insulative housing 1, a plurality of conductive contacts 2, a pair of switch contacts 3, a columnar-shaped post 4 and a rear cover 5 locking with the insulative housing 1. The contacts 2 are composed of a first contact 21, a second contact 22 and a third contact 23. In the preferred embodiment, the first contact 21 is a first signal contact, the second contact 22 is a grounding contact and the third contact 23 is a power contact. The switch contacts 3 contain a movable contact 31 and an immovable contact 32 mating with the movable contact 31 wherein the movable contact 31 is also a second signal contact.

The insulative housing 1 comprises a flat bottom wall 10, a pair of side surface 11, 12 respectively extending upward from the lateral sides of the bottom wall 10, an arched top wall 13 extending from the upper edges of the side surface 11, 12, a mating face 14 positioned in the front of the housing 1 and a rear wall 15 opposite to the mating face 14. A plug-insertion hole 16 is defined through the mating face 14 within the insulative housing 1 for accommodating the mating plug 200 therein. The insulative housing 1 comprises a pair of first and second mounting holes 111, 112 which are in a front-to-back arrangement adjacent to the side surface 12. There defines a third mounting hole 113 opposite to the first mounting hole 111 and a fourth mounting hole 114 at the back of the third mounting hole 113. The third and fourth mounting holes 113, 114 are disposed adjacent to another side surface 13 wherein the third mounting hole 113 is positioned near the mating face 14 and the fourth mounting hole 114 is disposed near the rear wall 15. All of the mounting holes 111, 112, 113, 114 are extending through the top wall 13 and the bottom wall 10 for respectively receiving the contacts 21, 22, 23, 31 thereof. The mounting holes 111, 112, 113, 114 respectively define a vertical groove 1111, 1121, 1131, 1141 and an opening 131, 132, 133, 134. The openings 131, 132, 133, 134 further contain a vertical retaining wall 1311, 1321, 1331, 1341, respectively. The mating face 14 defines a pair of first projecting posts 141. The rear wall 15 contains a recess 151 for receiving the immovable contact 32 and a pair of second projecting posts 152. The recess 151 defines a cambered slit 1511, a horizontal slot 1512 extending from a side of the slit 1511 and a vertical passageway 1513 in communication with the fourth opening 114. The horizontal slot 1512 extends through the side surface 12 The insulative housing 1 also defines a hole 17 through the top wall 13 and the bottom wall 10 for retaining the post 4 therein. The post 4 is adapted for intervening with the mating plug 200 and providing excellent feel of insertion and ejection.

Figure 1:
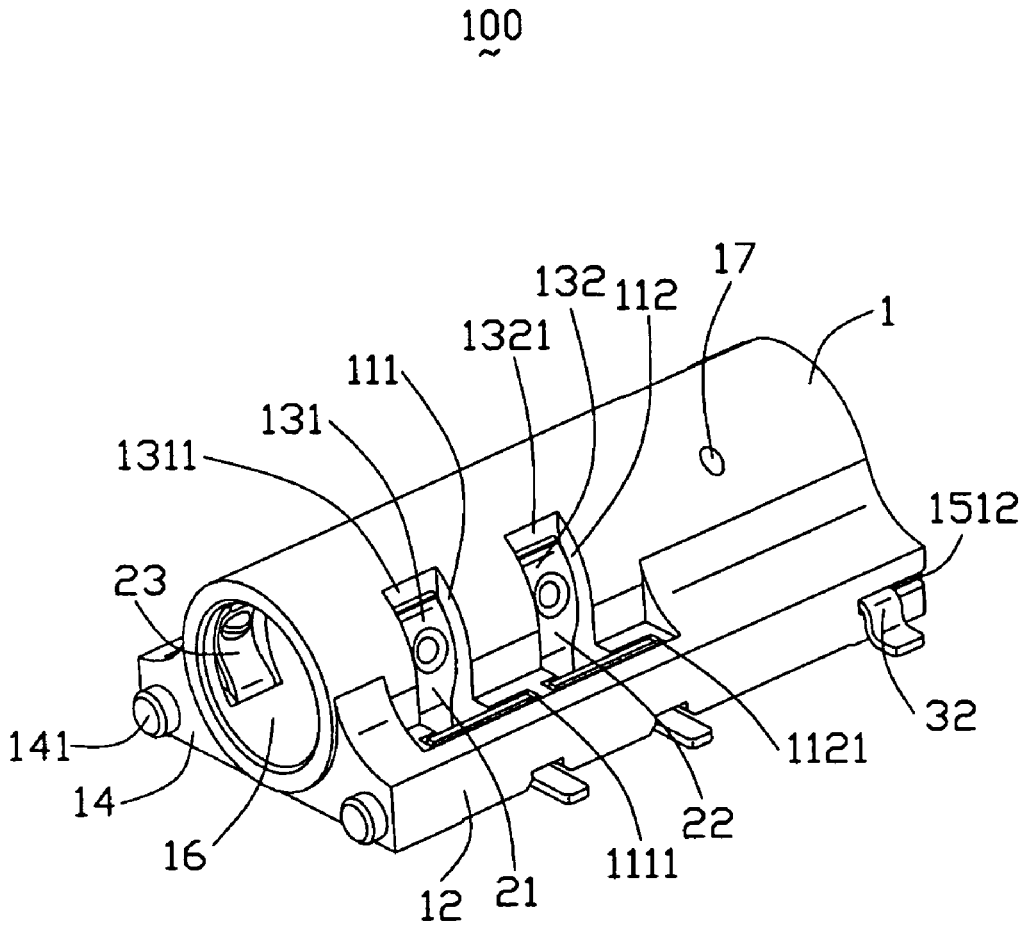
FIG. 1 is a perspective view of a miniature audio jack connector according to the present invention.
Figure 2:
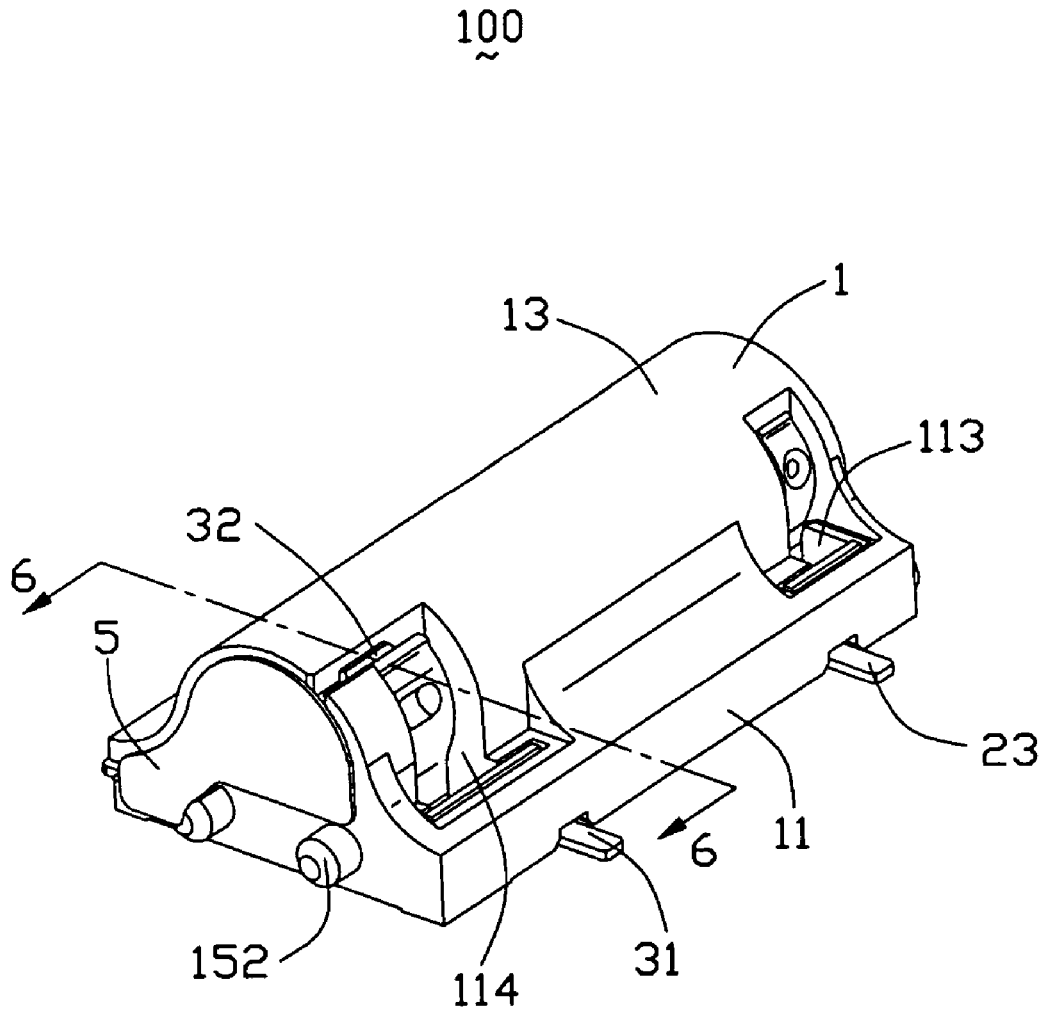
FIG. 2 is another perspective view of the audio jack connector shown in FIG. 1.
Figure 3:
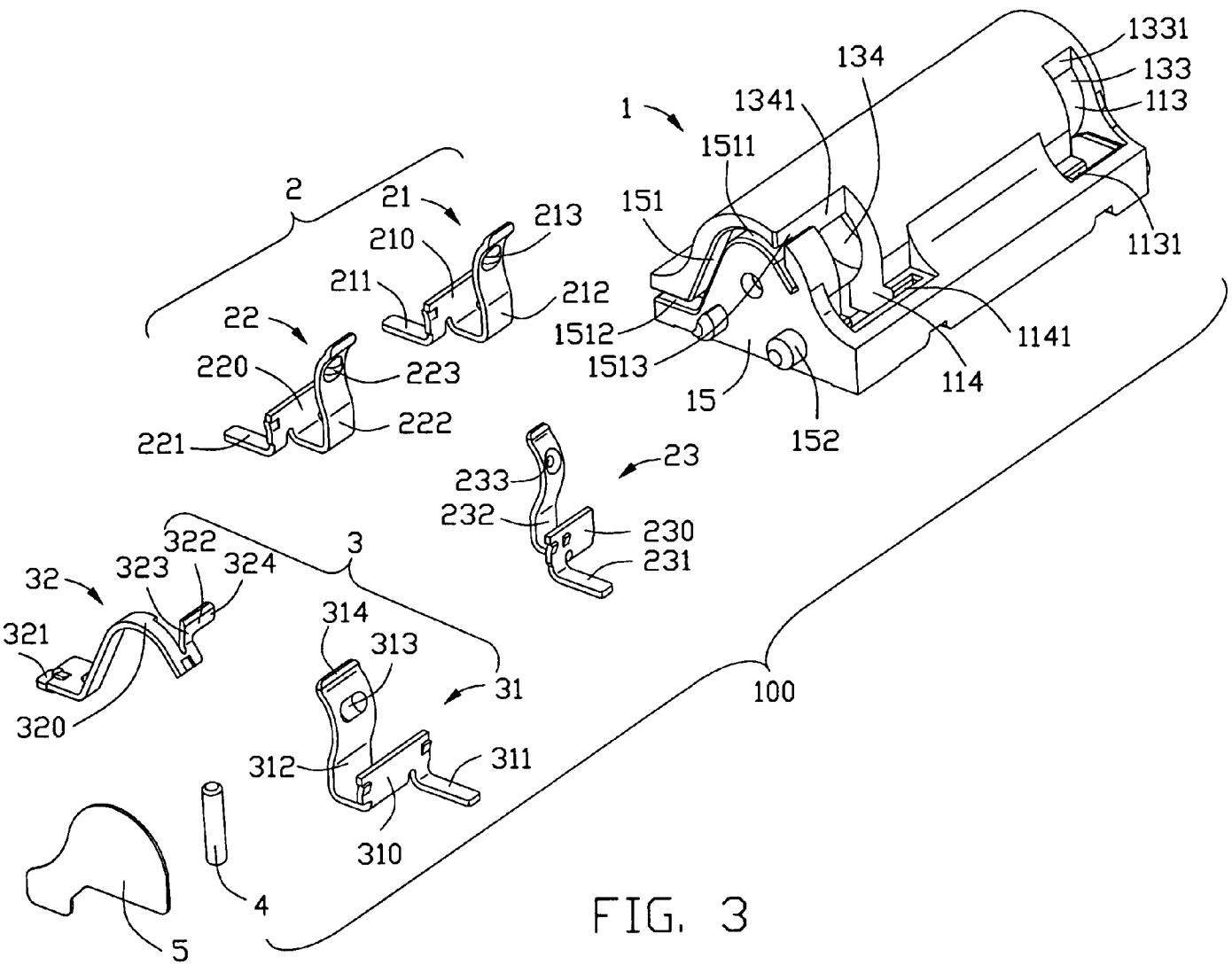
FIG. 3 is an exploded view of the audio jack connector shown in FIG. 1.
Figure 4:
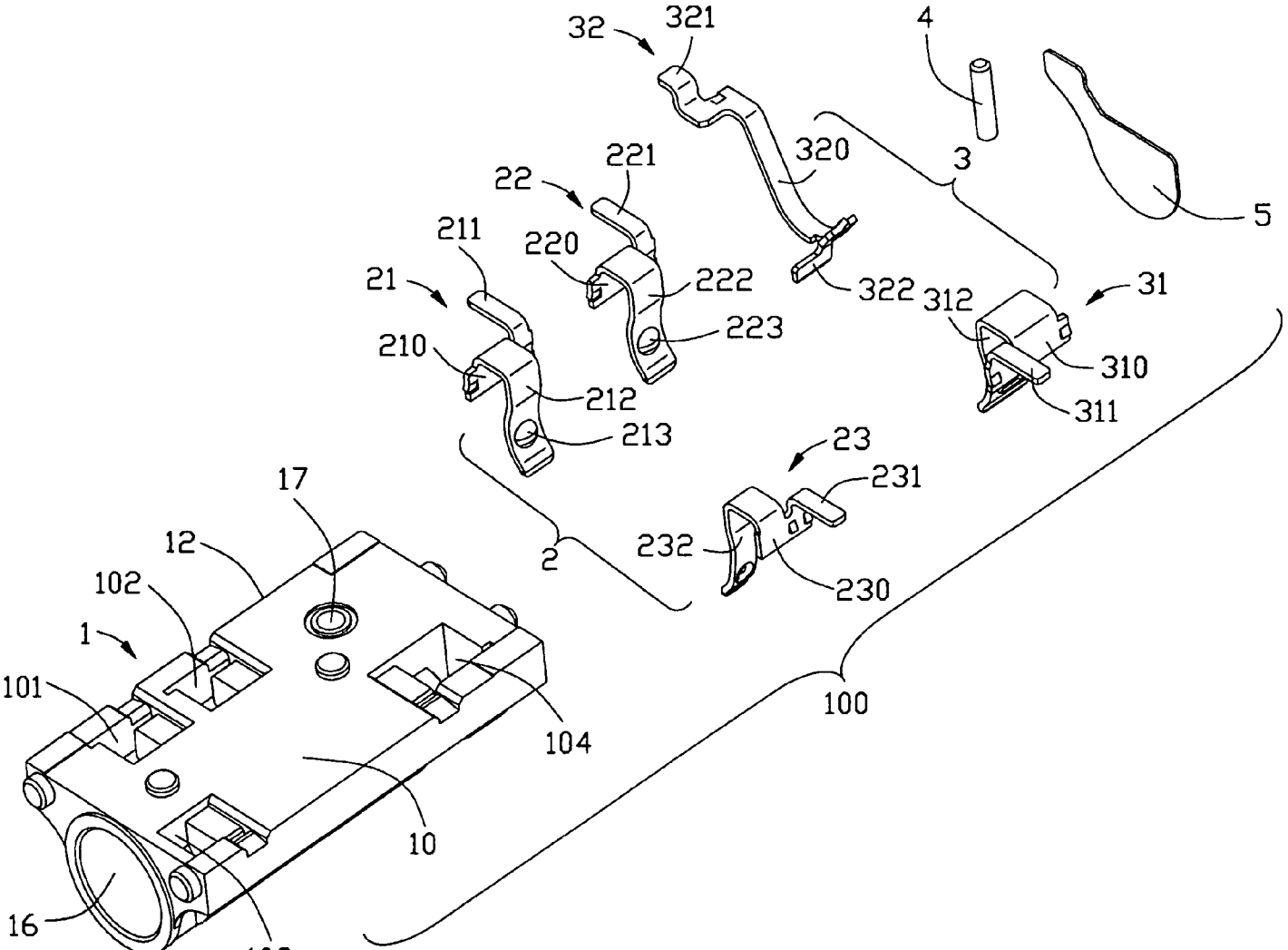
FIG. 4 is another exploded view of the audio jack connector.
Figure 5:
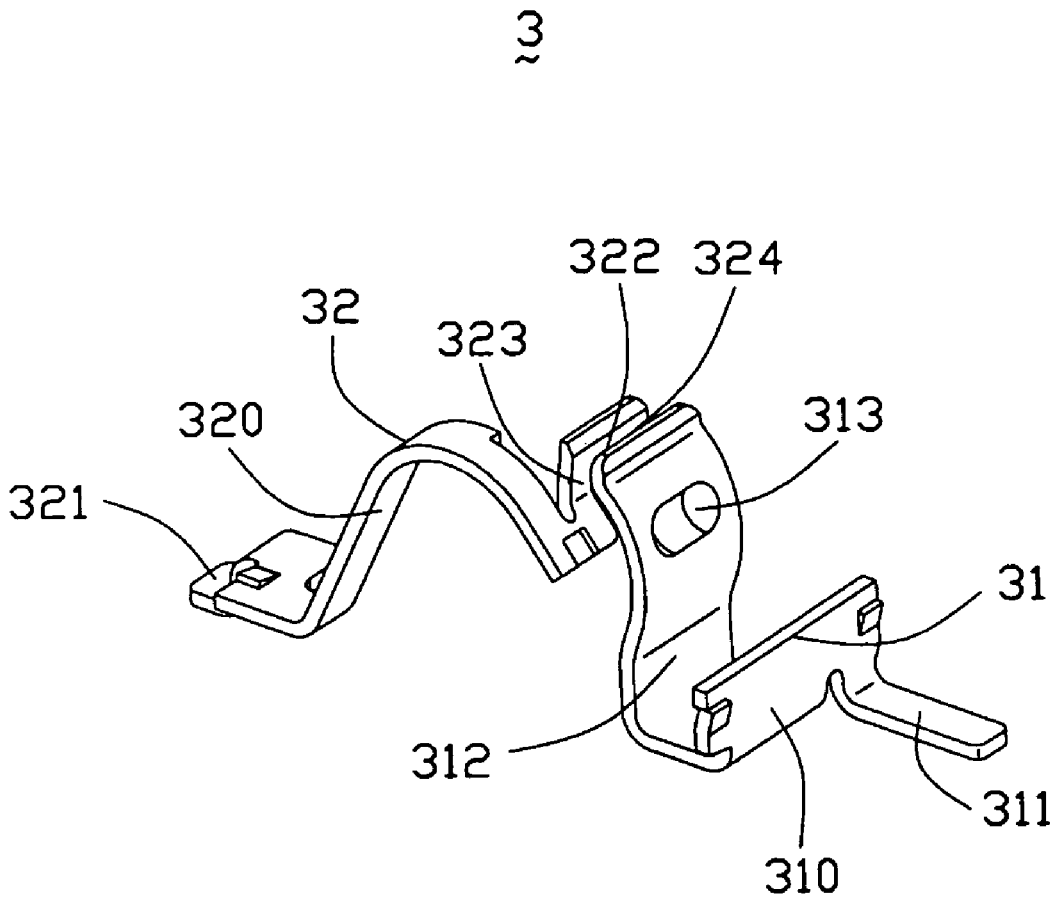
FIG. 5 is a perspective view of a pair of switch contacts.

Referring to FIGS. 3 to 5, all the contacts 21, 22, 23, 31 and 32 are made of conductive material. Each contact 21, 22, 23, 31, 32 respectively defines a retaining portion 210, 220, 230, 310, an elastic arm 212, 222, 232, 312 extending from and then being bent to be parallel to the retaining portion 210, 220, 230, 310 and a soldering portion 211, 221, 231, 311 extending beyond the side surface 11 and 12 for connecting with a printed circuit board (PCB, not shown). Each elastic arm 212, 222, 232, 312 defines a calotte emboss 213, 223, 233, 313 projecting into the plug-insertion hole 16 for engaging with the mating plug 200. The elastic arm 312 further contains a mating portion 314 at a distal end thereof.

The immovable contact 32 contains a cambered stationary portion 320, a soldering tail 321 extending from a side of the stationary portion 320 for connecting to the PCB and an L-shaped engaging portion 322 extending from the other side of the stationary portion 320. The engaging portion 322 contains a lock portion 323 retained in the passageway 1513 and a contact portion 324 perpendicular to the lock portion 323. The contact portion 324 abuts against the retaining wall 1341 and engages with the mating portion 314 of the movable contact 31.

Figure 6:
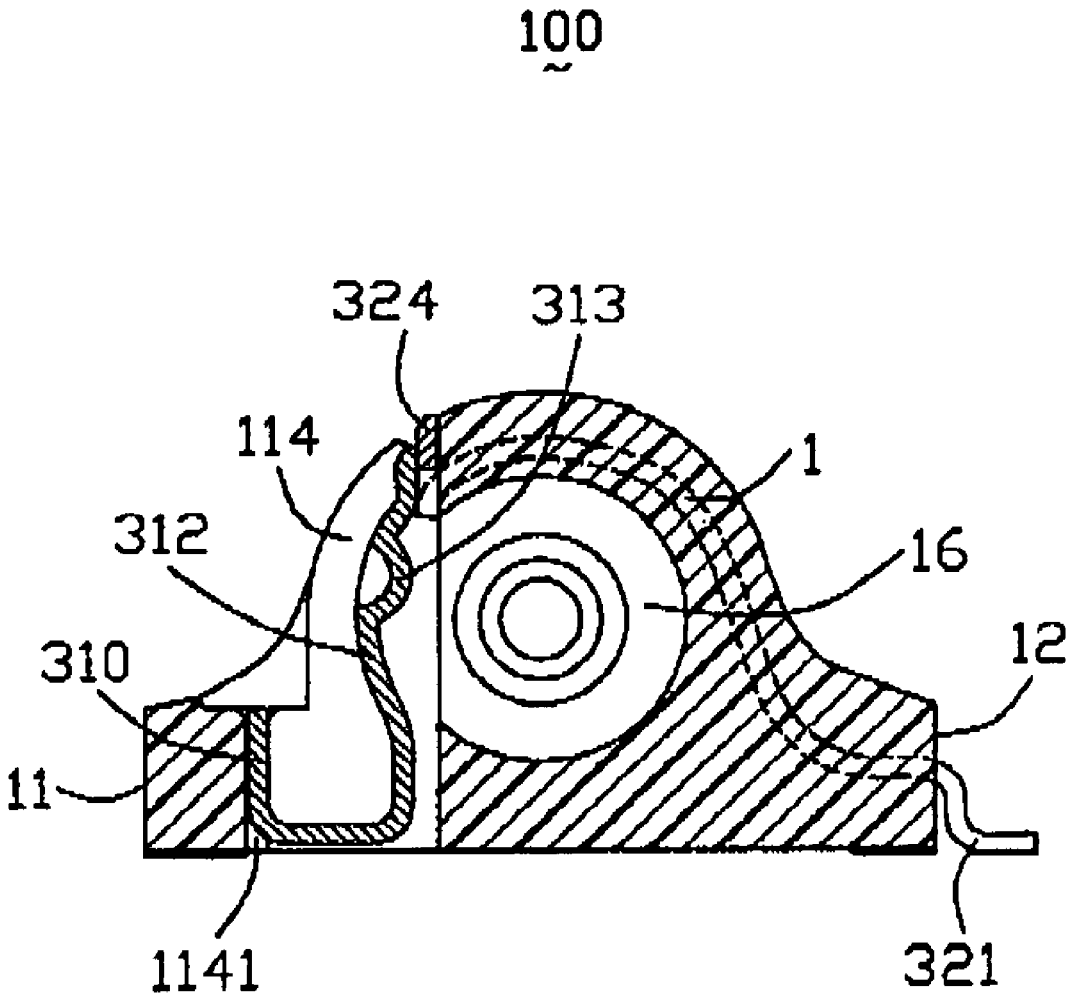
FIG. 6 is a cross-sectional view of the audio jack connector taken along line 6-6 of FIG. 2 before insertion of a mating plug.

Referring to FIGS. 1-5, in assembly, firstly, the immovable contact 32 is inserted in the recess 151 from the rear wall 15 of the housing 1. The soldering tail 321 is retained in the horizontal slot 1512 and extends beyond the side surface 12. Then, the contacts 21, 22, 23 and 31 are inserted into corresponding mounting holes 111, 112, 113, 114 from the bottom wall 10 of the insulative housing 1. The retaining portions 210, 220, 230, 310 are fixed in the complementary grooves 1111, 1121, 1131, 1141. The elastic arms 212, 222, 232, 312 are extending into the openings 131, 132, 133, 134 wherein the distal ends of the elastic arms 212, 222, 232 abut against corresponding retaining walls 1311, 1321, 1331 for over pressure. Pease further refer to FIGS. 6 and 7, the movable contact 31 is positioned on one side of the plug-insertion hole 16 and the immovable contact 32 is substantially positioned on the other side of the plug-insertion hole 16. The contact portion 324 of the immovable contact 32 extends beyond a center line of the plug-insertion hole 16 to engage with the mating portion 314 of the movable contact 31 before insertion of the plug 200. The elastic arms 212, 222, 232, 312 are exposed outside. The soldering portions 211, 221, 231, 311 go beyond the bottom wall 10 of the housing 1. The post 4 is inserted into the hole 17 and the post 4 is positioned in the plug-insertion hole 16 for intervening with the mating plug 200. Finally, the panel-shaped rear cover 5 is mounted on the rear wall 15 of the housing 1 by using a kind of glue.

When the mating plug 200 is inserted into the plug-insertion hole 16 of the insulative housing 1, the plug 200 abuts against the embosses 213, 223, 233, 313, thereby electrically connecting the contacts 21, 22, 23, 31. With the insertion of the plug 200, it contacts with the emboss 313 and drives the elastic arm 312 of the movable contact 31 moving outwardly within the opening 134. The mating portion 314 of the elastic arm 312 deviates from the contact portion 324 of the immovable contact 32, thereby forming detection circuit with the PCB and achieving a switch purpose. Furthermore, the post 4 is adapted for abutting against the front portion of the mating plug 200 and enhancing engaging force.

Comparing with the prior art, the elastic arm 312 moves in the opening 134 of the top wall 13, thereby saving the space inside the insulative housing 1. Besides, the emboss 313 occupies a small space of the plug-insertion hole 16. Thus the plug-insertion hole 16 is configured to the plug 200 and doesn't need a large dimension. Further more, the arched shaped insulative housing 1 reduces its profile as well.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for electrically connecting a mating plug, comprising:

an insulative housing defining a plug-insertion hole surrounded by a peripheral wall thereof, said peripheral wall comprising an arched shaped top wall which defines an opening extending through the top wall and communicating with the plug-insertion hole; and a pair of switch contacts comprising a movable contact and an immovable contact, the movable contact defining a mating portion contactable with the immovable contact and an engaging portion extending into the plug-insertion hole for abutting against the plug, said movable contact being deflectable within said opening when the plug is inserted and drives said engaging portion to move outwardly with the mating portion disengaging from the immovable contact, wherein the insulative housing defines a mating face and a rear wall opposite to the mating face, the rear wall defining a recess for insertion of the immovable contact therethrough, wherein the recess comprises a cambered slit and a slot in communication with the slit, and wherein said immovable contact defines a cambered stationary portion retained in the slit and a soldering tail fixed in the slot and extending beyond the insulative housing.

2. The electrical connector according to claim 1, wherein the movable contact defines an elastic arm moving within the opening, said mating portion formed at a distal end of the elastic arm.

3. The electrical connector according to claim 2, wherein the engaging portion of the movable contact is a calotte emboss formed on the elastic arm.

4. The electrical connector according to claim 1, wherein the insulative housing defines a retaining wall within the opening, the movable contact defining a contact portion substantially abutting against the retaining wall and electrically connecting with the movable contact.

5. The electrical connector according to claim 1, wherein the movable contact and the immovable contact both define soldering portions for electrically connecting a printed circuit board (PCB).

6. The electrical connector according to claim 1, wherein the rear wall defines a passageway in communication with the recess, the immovable contact defining a lock portion retained in the passageway and a contact portion substantially perpendicular to the locking portion for mating with the mating portion of the movable contact.

7. The electrical connector according to claim 1, further comprising a rear cover covering the recess.

8. The electrical connector according to claim 1, further comprising a plurality of conductive contacts retained in the insulative housing.

9. The electrical connector according to claim 8, wherein each conductive contact defines a retaining portion, an arm comprising an emboss extending into the plug-insertion hole and a soldering portion extending beyond the insulative housing.

10. The electrical connector according to claim 1, further comprising a post, said insulative housing defining a hole for accommodating the post, the post extending into the plug-insertion hole for abutting against the mating plug.

11. The electrical connector according to claim 1, wherein the electrical connector is an audio jack connector.

12. An electrical connector comprising:

an insulative housing defining a columnar receiving cavity for receiving a columnar plug;

a plurality of contacts disposed in the housing with engaging sections extending into the receiving cavity; and a pair of switch contacts assembled to the housing, said pair of switch contacts comprising a moveable deflectable contact and an immoveable contact, the moveable deflectable contact having an engaging portion extending into the receiving cavity and further having a first mating section, the immoveable contact having a second mating section on-and-off engageable with the first mating section, determined by whether the plug is inserted into the receiving cavity or not; wherein said pair of switch contacts essentially are respectively positioned by two opposite lateral sides of the receiving cavity while one of said pair of switch contacts by one side of the receiving cavity extends beyond a center line of said receiving cavity so as to have a corresponding one of said first and second mating sections reach the other on the other side.

13. The connector as claimed in claim 12, wherein said first mating section and said second mating section are disengaged from each other when the plug is inserted into the receiving cavity.

14. The connector as claimed in claim 12, wherein the second mating section of the immoveable contact extends over the center line to reach the moveable contact.

15. The connector as claimed in claim 12, wherein the housing defines a curved slot in a front-to-back direction to snugly received said one of the pair of switch contacts while the other is moveably disposed in an opening much larger than said other of the pair of switch contacts.

16. The connector as claimed in claim 15, wherein said slot communicates with an exterior in an axial direction while said opening communicates with the exterior in a radial direction perpendicular to said axial direction.

17. An electrical connector comprising:

an insulative housing defining a columnar receiving cavity for receiving a columnar plug;

a plurality of contacts disposed in the housing with engaging sections extending into the receiving cavity; and a pair of switch contacts assembled to the housing, said pair of switch contacts comprising a moveable deflectable contact and an immoveable contact, said moveable deflectable contact having an engaging portion extending into the receiving cavity and further having a first mating section, and said immoveable contact having a second mating section on-and-off engageable with the first mating section, determined by whether the plug is inserted into the receiving cavity or not; wherein the moveable contact is installed into an opening located in the housing and communicating with an exterior in a radial direction while the immoveable contact is inserted into a curved slot in an axial direction perpendicular to said radial direction.

* * * * *